US012617647B2

(12) United States Patent
Rizzuti

(10) Patent No.: US 12,617,647 B2
(45) Date of Patent: May 5, 2026

(54) ADJUSTABLE SHINGLE TO FACILITATE STACKING

(71) Applicant: GEO. M. MARTIN COMPANY, Emeryville, CA (US)

(72) Inventor: Charles D. Rizzuti, Martinez, CA (US)

(73) Assignee: GEO. M. MARTIN COMPANY, Emeryville, CA (US)

( * ) Notice: Subject to any disclaimer, the term of this patent is extended or adjusted under 35 U.S.C. 154(b) by 306 days.

(21) Appl. No.: 18/496,005

(22) Filed: Oct. 27, 2023

(65) Prior Publication Data

US 2025/0136396 A1 May 1, 2025

(51) Int. Cl.

| | |
|---|---|
| ***B65H 33/12*** | (2006.01) |
| ***B65H 29/18*** | (2006.01) |
| ***B65H 29/66*** | (2006.01) |
| ***B65H 31/10*** | (2006.01) |

(52) U.S. Cl.

CPC ..... *B65H 33/12* (2013.01); *B65H 29/18* (2013.01); *B65H 29/6618* (2013.01); *B65H 31/10* (2013.01); *B65H 2301/16* (2013.01); *B65H 2513/20* (2013.01); *B65H 2701/1764* (2013.01); *B65H 2801/42* (2013.01)

(58) Field of Classification Search

CPC ..... B65H 29/6618; B65H 29/6627; B65H 33/12; B65H 29/6609; B65H 29/68

See application file for complete search history.

(56) References Cited

U.S. PATENT DOCUMENTS

| | | | | |
|---|---|---|---|---|
| 3,938,674 | A | 2/1976 | Kroeze et al. | |
| 3,994,221 | A * | 11/1976 | Littleton | B65H 29/6627 271/202 |
| 4,111,411 | A * | 9/1978 | Graves | B65H 31/30 198/577 |
| 4,200,276 | A | 4/1980 | Marschke | |
| 4,265,443 | A * | 5/1981 | Berthelot | B65H 29/6618 271/200 |
| 4,273,325 | A | 6/1981 | Rodewald | |
| 4,289,052 | A | 9/1981 | Woolston et al. | |
| 4,313,600 | A * | 2/1982 | Mosburger | B65H 29/50 271/256 |
| 4,436,302 | A | 3/1984 | Frye et al. | |
| 4,598,901 | A | 7/1986 | Thomas | |
| 5,050,859 | A | 9/1991 | Paxon | |
| 5,613,673 | A | 3/1997 | Roberts et al. | |
| 5,913,656 | A | 6/1999 | Collins | |
| 6,561,507 | B1 | 5/2003 | Pollock | |
| 6,694,706 | B1 * | 2/2004 | Odenthal | B65H 29/6636 53/235 |

(Continued)

FOREIGN PATENT DOCUMENTS

| | | |
|---|---|---|
| CA | 2528225 | 8/2012 |
| EP | 0149737 B1 | 4/1987 |

(Continued)

*Primary Examiner* — Jeremy R Severson

(74) *Attorney, Agent, or Firm* — PEARL COHEN ZEDEK LATZER BARATZ LLP

(57) ABSTRACT

A system for conveying blanks to a stacker creates a big enough time gap between a last blank of a current stack and the first blank of the next stack to allow the stacker to discharge the current stack without interrupting the feed of new sheets for the next stack.

24 Claims, 12 Drawing Sheets

(56) References Cited

U.S. PATENT DOCUMENTS

| | | | | |
|---|---|---|---|---|
| 6,945,531 | B2 * | 9/2005 | Perobelli | B65H 29/66 271/69 |
| 7,052,009 | B2 | 5/2006 | Roth | |
| 8,622,379 | B2 | 1/2014 | Fokos | |

FOREIGN PATENT DOCUMENTS

| | | | |
|---|---|---|---|
| EP | 2376356 | B1 | 11/2017 |
| EP | 2739553 | B1 | 3/2018 |
| GB | 2074990 | | 11/1981 |

* cited by examiner

ADJUSTABLE SHINGLE TO FACILITATE STACKING

BACKGROUND

Manufacturers of corrugated paper products produce both foldable boxes which have been folded and glued at the factory and die cut flat sheets which may be used either in their flat state or folded into a desired shape. These will be referred to as folded boxes and flat boxes respectively. The term boxes alone can refer to both folded and flat boxes.

Both the folded boxes and the flat boxes are produced by converting machinery which processes corrugated sheet stock produced by machinery known as a Corrugator. The corrugated sheet stock is corrugated material cut to a specific size with optional scoring. Scoring is the intentional crushing of the corrugated flutes in order to allow folding of the corrugated material. However, the corrugated sheet stock has not been cut or notched to the detail typically required to produce the final foldable boxes or the flat boxes. For purposes of this document, the corrugated sheet stock shall be referred to as sheets. The term sheets can also be used to refer to similar or analogous materials formed into sheets.

Often customized printing is required on boxes which may be done by using a preprinted material integrated into the corrugated sheet stock on the Corrugator, using flexographic printing during the converting process or applying ink or labels post converting through various techniques.

During the converting process, the sheets are transformed into a box by performing additional cutting and optionally adding scoring and/or printing. There are multiple possible purposes for the additional cutting of the sheets. Many of these cutting operations will result in pieces of the sheets being completely separated from the final box. These pieces are, in general, referred to as scrap. As the boxes are produced they are aggregated into stacks of the boxes which in turn are sold or transported elsewhere.

There are multiple methods by which the cutting of the sheets may be accomplished during the converting process. One example method for cutting sheets is known as rotary die cutting. A typical configuration of a rotary die cutter, known as rule and rubber, uses a pair of cylinders where the lower cylinder, known as the anvil, is covered in a firm but soft rubber material and the top cylinder is mounted with a die board. The die board is normally a curved plywood base in which embedded are a customized set of steel rules, which protrude from the plywood base and when rotated with the anvil will cut and score the corrugated sheet stock into the final desired box.

The input to the rotary die cutter are the sheets of corrugated sheet stock. The rotary die cutter can cut a sheet into multiple smaller sheets, referred to herein as blanks. The sheets may be cut in the cross-machine direction in one or more locations to create two or more boxes in the through-machine direction. These are referred to as Ups. The sheets may also be cut in the through-machine direction in one or more locations to create two or more boxes in the cross-machine direction. These are referred to as Outs. Ups and Outs are both examples of blanks.

After the rotary die cutter, one or more apparatus transport the blanks using one or more means of conveyance to a stacker to create stacks of blanks that can be provided to a customer or other entity. When the stacker has aggregated enough blanks to have a full stack, that full stack must be removed from the stacker. To allow time for the system to remove the full stack, prior art systems include feed interrupt time during which no sheet is input to the rotary die cutter to allow a gap between blanks at the end of a stack so that the stacker has time to remove the full stack from the stacker. However, including feed interrupt time reduces the throughput of the box making system.

DETAILED DESCRIPTION

A system is proposed for conveying blanks to a stacker that creates a big enough time gap between a last blank of a current stack and the first blank of the next stack to allow the stacker to discharge the current stack without interrupting the feed of new sheets into the rotary die cutter.

Figure 1:
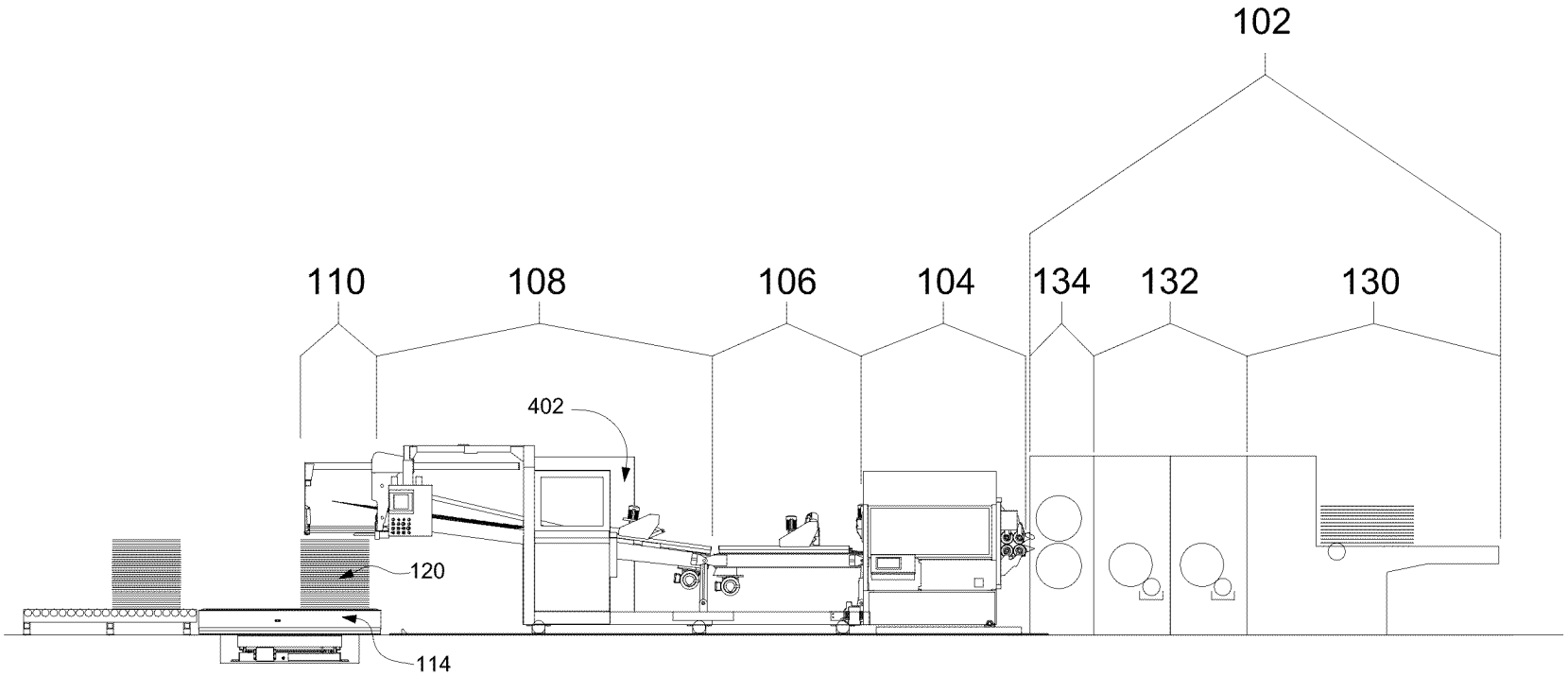
FIG. 1 depicts a side view of a system for making boxes.

FIG. 1 depicts a side view of one embodiment of a box making system that includes the proposed technology. More specifically, FIG. 1 shows rotary die cutter 102, layboy 104, transfer conveyor 106, stacking conveyor 108 and stacker 110. Rotary die cutter 102 has three primary sections: feed table section 130, printing section 132 and the die cutting section 134. Feed table section 130 is where an operator feeds new sheets of corrugated sheet stock into rotary die cutter 102. Printing section 132 is configured to print text and images on the sheets. Die cutting section 134 is configured to cut and/or score the sheets. Additionally, rotary die cutter 102 includes a sheet feed sensor (not depicted in FIG. 1) that senses when a new sheet is fed into rotary die cutter 102.

The output from rotary die cutter 102, comprising one or more blanks (e.g., Ups and Outs), are received by layboy 104, which functions to receive the blanks from rotary die cutter 102 and assists in the removing of the scrap from the blanks. Sometimes, speed variations are implemented by layboy 104 to cause a gap between blanks.

Transfer conveyor 106 receives blanks from layboy 104 and performs a shingling function. This is where the blanks can be changed from a serial stream of non-overlapping blanks to blanks that are shingled (i.e., partially overlapping). In one embodiment, transfer conveyor 106 moves blanks at a slower speed than layboy 104 moves blanks, thereby causing the blanks to overlap and create shingling of blanks. In one embodiment, layboy 104 moves blanks at a faster speed than rotary die cutter 102 outputs blanks in order to create a gap between blanks prior to the shingling by transfer conveyor 106.

Stacking Conveyor 108 receives blanks from transfer conveyor 106 and delivers the blanks to stacker 110. Stacker 110 is where the blanks are stacked. More details of stacker 110 are provided below. Stacking Conveyor 108 changes elevation in order to accommodate the elevation change of the growing stack of blanks 120 in stacker 110 such that the conveyed blanks are deposited on the top of the stack of blanks 120. An alternative method is for stacking conveyor 108 to remain at a fixed elevation and the stack support surface (comprising discharge conveyor 114) of stacker 110 under the growing stack of blanks 120 can move down, again such that the conveyed blanks are deposited on the top of the stack.

Figure 2:
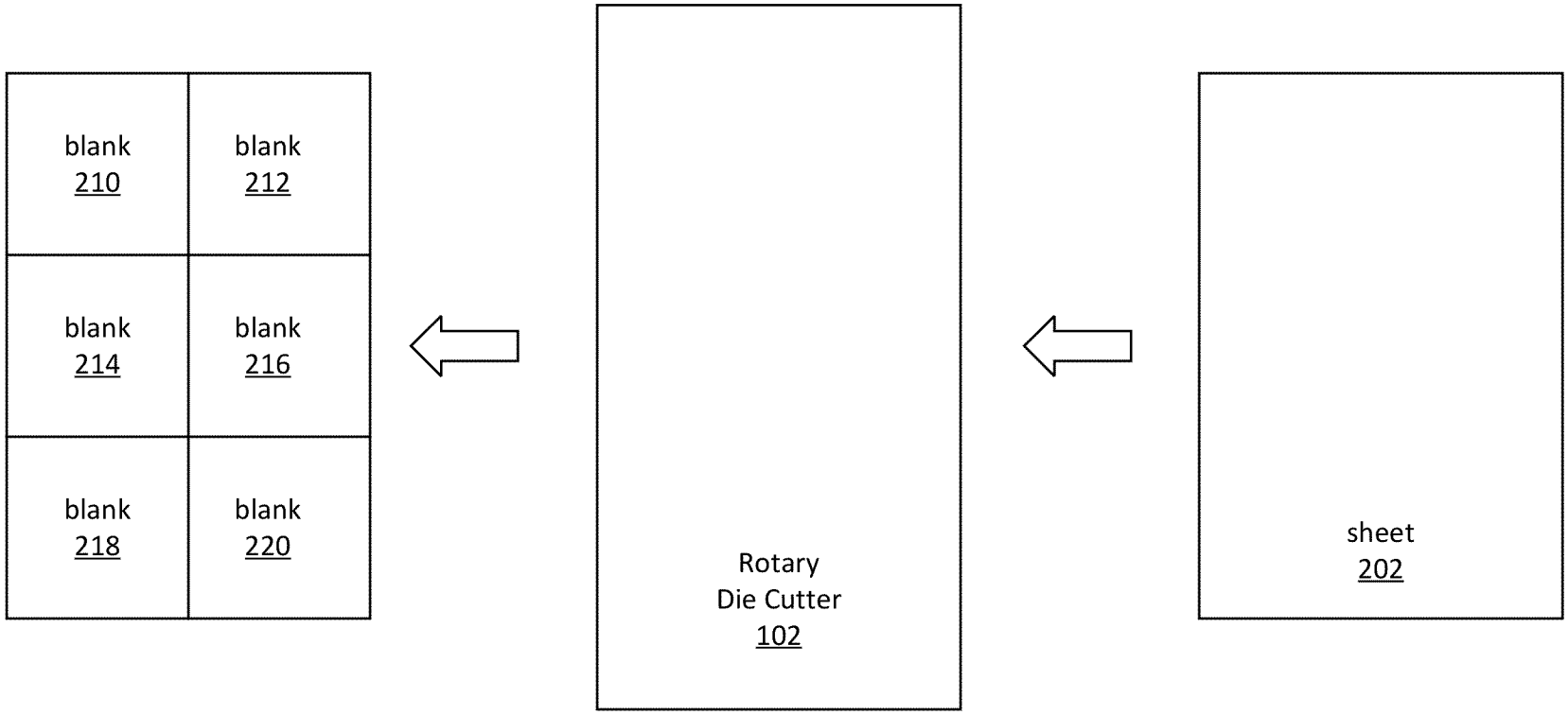
FIG. 2 describes sheets and blanks.

FIG. 2 describes the relationship of sheets to blanks. As mentioned above, sheets (e.g., corrugated sheet stock) 202 are input to rotary die cutter 102, which can cut, score and print on the sheets. The outputs of rotary die cutter 102 are referred to as blanks. Thus, a sheet of corrugated sheet stock is referred to as a blank after it has been processed by rotary die cutter 102. The exact scheme for cutting and scoring sheets is job (order) specific and is typically based on the dimensions of the desired blank and the dimensional limitations of the die board. Thus, it is possible that one sheet is cut and/or scored such that one blank is produced. It is also possible that rotary die cutter 102 cuts one sheet into multiple separate blanks. The sheets may be cut in the cross-machine direction or through-machine direction to create Ups and Outs (as described above). FIG. 2 shows an example where one sheet 202 is cut into six blanks 210, 212, 214, 216, 218 and 220. In this example, sheet 202 is cut into three blanks in the cross-machine direction (Outs) and two blanks in the through-machine direction (Ups). In other examples, a sheet can be cut into more or less than three blanks in the cross-machine direction and more or less than two blanks in the through-machine direction. The technology described herein is not limited to any number of blanks per sheet. Additionally, the term "blank" need not be limited to corrugated sheet stock as a "blank" can refer to a processed sheet of other suitable material.

Figure 3A:
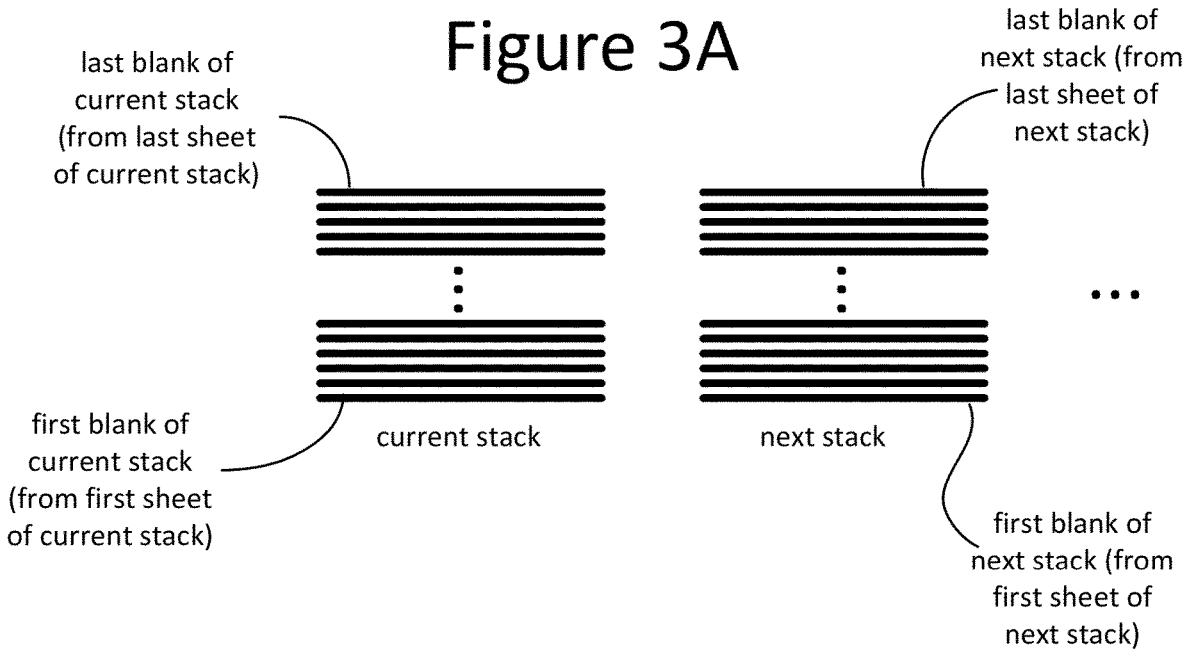
FIG. 3A depicts stacks of blanks.
Figure 3B:
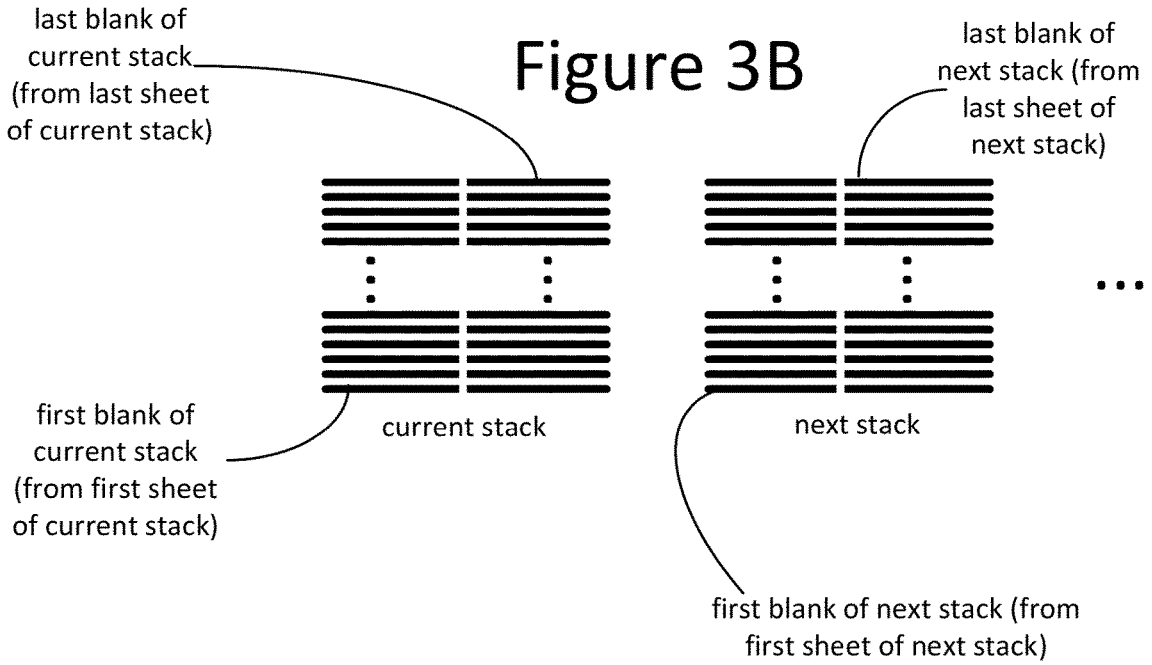
FIG. 3B depicts stacks of blanks.

The technology described herein pertains to conveying blanks to a stacker (e.g., stacker 110). The stacker creates stacks of blanks, which are then transported for sale or use by a customer or other entity. While the stacker is creating a stack, that stack being created is referred to as the current stack. The next stack to be created after the current stack is referred to as the next stack. This is depicted in FIGS. 3A and 3B, both of which show a current stack and a next stack. FIG. 3A depicts the example where a single sheet is processed by a rotary die cutter (or other machine) to create a single blank. FIG. 3B depicts the example where a single sheet is processed by a rotary die cutter (or other machine) to create multiple blanks. Each stack includes a first blank and a last blank such that the current stack includes a first blank of the current stack and a last blank of the current stack, and the next stack includes a first blank of the next stack and a last blank of the next stack. The first blank of the current stack was created by the rotary die cutter from the first sheet for the current stack. The last blank of the current stack was created by the rotary die cutter from the last sheet for the current stack. The first blank of the next stack was created by the rotary die cutter from the first sheet for the next stack. The last blank of the next stack was created by the rotary die cutter from the last sheet for the next stack. The technology described herein is used to create a big enough time gap between a last blank of a current stack and the first blank of the next stack to allow stacker 110 to discharge the current stack without interrupting the feed of new sheets into rotary die cutter 102.

Figure 4:
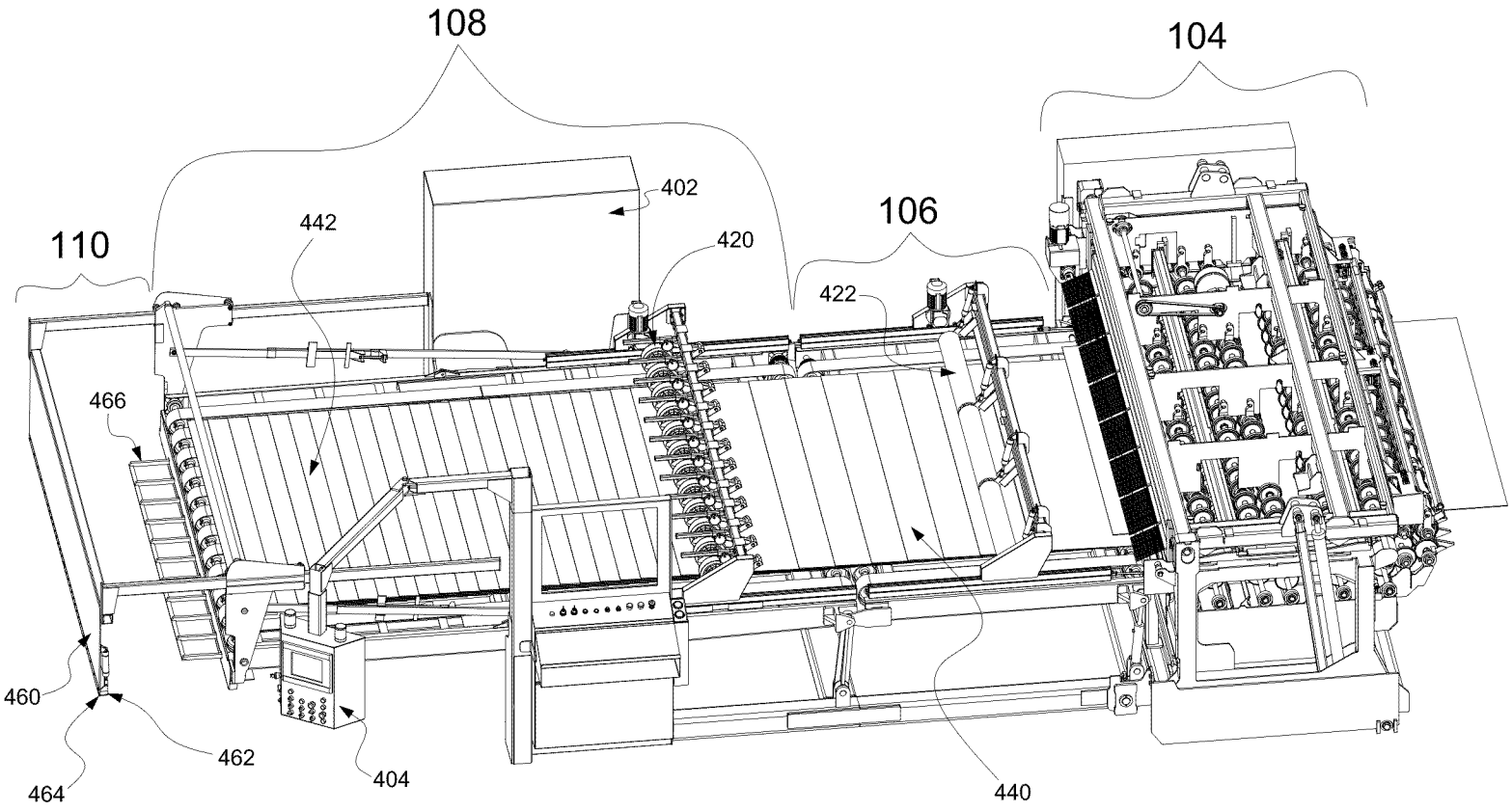
FIG. 4 depicts a perspective view of a portion of the system of FIG. 1.

FIG. 4 depicts a perspective view of a portion of the system of FIG. 1. Specifically, FIG. 4 shows layboy 104, transfer conveyor 106, stacking conveyor 108 and stacker 110 in more detail. Layboy 104 includes motorized wheels above and below the blanks to move the blanks from rotary die cutter 102 to transfer conveyor 104. In one embodiment, layboy 104 runs at the speed of rotary die cutter 102. In another embodiment, layboy 104 runs faster than rotary die cutter 102 in order to create a gap between the blanks in the through machine direction.

FIG. 4 also shows computer system 402, which is connected to and controlled by operator interface 404. Computer system 402 includes one or more processors, memory, a hard drive and a communication interface (e.g., network or Ethernet card). Operator interface 404, which is physically and electrically connected to computer system 402, includes a monitor, pointing device and keyboard. In one alternative, operator interface 404 comprises a tablet with a touch interface. Computer system 402 (including the one or more processors) is connected to and controls rotary die cutter 102, layboy 104, transfer conveyor 106, stacking conveyor 108 and stacker 110. For example, computer system 402 controls the speeds of transfer conveyor 106 and stacking conveyor 108. Computer system 402 also receives a signal from the sheet feed sensor (discussed below) and uses that signal in combination with the length and speeds of rotary die cutter 102, layboy 104, transfer conveyor 106 and stacking conveyor 108 to track the instantaneous location of each blank.

Transfer conveyor 106 includes a motor connected to a plurality of wheels that drive a plurality of belts. Blanks are positioned on the belts so that the belts move the blanks. The motor is controlled by computer system 402. Other forms of conveyors can also be implemented, including wheels with no belts. Transfer conveyor 106 also includes snubbing wheels 422 that contact blanks when the blanks land on transfer conveyor 106. Snubbing wheels 422 are used to abruptly change the speed of the blanks to the speed of transfer conveyor 106 when the blanks land on transfer conveyor 106.

Stacking conveyor 108 includes a motor connected to a plurality of wheels that drive a plurality of belts. Blanks are positioned on the belts so that the belts move the blanks. The motor is controlled by computer system 402. Other forms of conveyors can also be implemented, including wheels with no belts. Stacking conveyor 108 also includes snubbing wheels 420 that contact blanks when the blanks land on stacking conveyor 108. Snubbing wheels 420 are used to abruptly change the speed of the blanks to the speed of stacking conveyor 108 when the blanks land on stacking conveyor 108. The motor for stacking conveyor 108 is separate from and different than the motor for transfer conveyor 106 such that computer system 402 controls the motor for stacking conveyor 108 independent from its control of the motor for transfer conveyor 106.

Blanks have cutouts and all different shapes and sizes. Not one set of speeds can be used for all different orders. There are many factors that determine what speeds the belts can be run to consistently get good quality stacks and not cause jams.

Stacker 110 is used to build stacks of blanks. The number of blanks in the stack is set by the operator and can vary from order to order. Stacker 110 includes a backstop 460 and a backstop lip 462 connected to backstop 460 by piano hinge 464. Stacker 110 also includes accumulator 466 and a stack support surface comprising discharge conveyor 114 (see FIG. 1). Other forms of stackers can also be implemented including designs that omit the backstop lip and piano hinge, or accumulator designs featuring a curtain apparatus.

In one embodiment, the speed (e.g., belt speed) of stacking conveyor 108 is different than the speed (e.g., belt speed) of transfer conveyor 106 and the speed of transfer conveyor 106 is different (e.g., slower) than the speed of layboy 104. Operating transfer conveyor 106 at a slower speed than layboy 104 causes blanks to become shingled when they transition from layboy 104 to transfer conveyor 106. For purposes of this document, blanks are shingled when consecutive blanks are partially overlapped. For purposes of this document, the term "shingle distance" refers to the length between the leading edge of a blank and the leading edge of the next blank. FIG. 4 shows blanks 440 traveling on (being moved by) transfer conveyor 106. FIG. 4 shows blanks 442 traveling on (being moved by) stacking conveyor 108. In the example of FIG. 4, blanks 440 have a larger shingle distance than blanks 442 because stacking conveyor 108 is operating at a slower speed (e.g., slower belt speed) than transfer conveyor 106.

Figure 5:
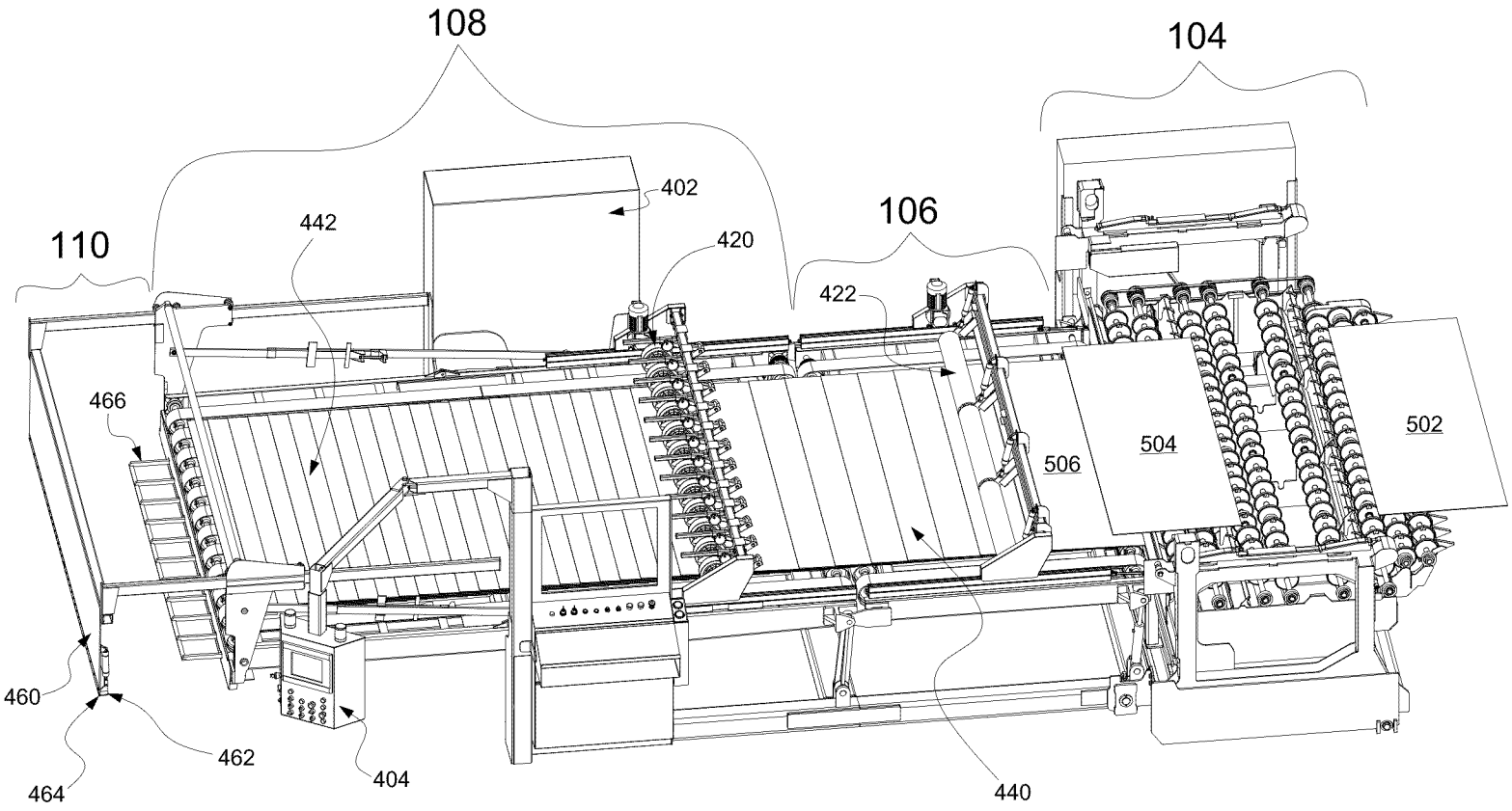
FIG. 5 depicts a perspective view of a portion of the system of FIG. 1.

FIG. 5 depicts a perspective view of a portion of the system of FIG. 1. Specifically, FIG. 5 shows layboy 104, transfer conveyor 106, stacking conveyor 108 and stacker 110 in more detail. FIG. 5 is similar to FIG. 4, except that FIG. 5 shows layboy 104 with the top wheels removed. As can be seen, FIG. 5 shows blanks 502, 504 and 506. Blank 502 has just entered layboy 104. Blank 506 has just transitioned from layboy 104 to transfer conveyor 106. Blank 504 is in the process of transitioning from layboy 104 to transfer conveyor 106 (i.e., it is landing on transfer conveyor 106) and is in the process of being shingled on top of blank 506 due to transfer conveyor 106 running slower than layboy 104.

Figure 6:
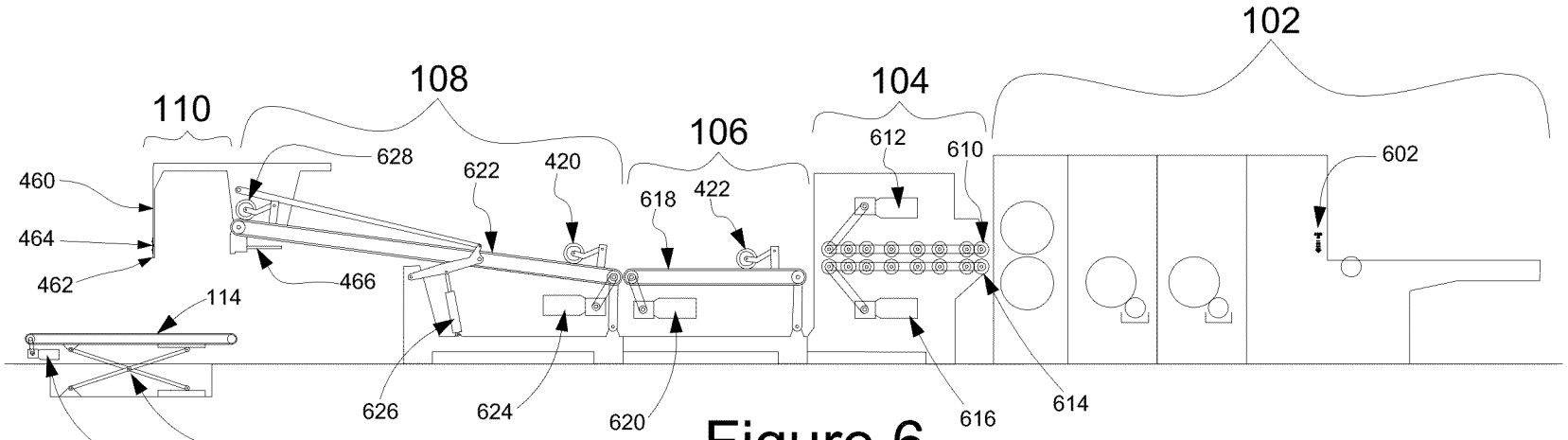
FIG. 6 depicts a simplified drawing of the system of FIG. 1.
Figure 7:
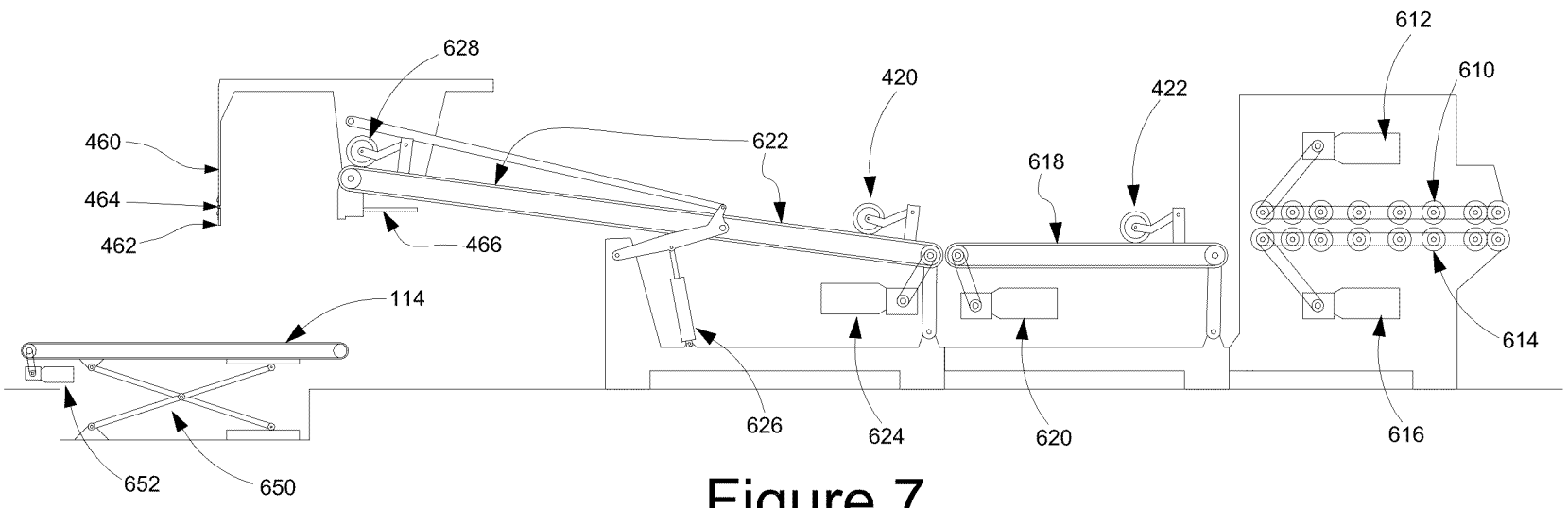
FIG. 7 depicts a simplified drawing of a portion of the system of FIG. 1.

FIG. 6 depicts a simplified drawing of the system of FIG. 1. FIG. 7 depicts a zoomed in view of a portion of FIG. 6 that depicts layboy 104, transfer conveyor 106, stacking conveyor 108 and stacker 110. FIG. 6 shows rotary die cutter 102 including a sheet feed sensor 602 (also known as a feed eye). In one embodiment, sheet feed sensor 602 comprises a laser and an optical sensor. In some implementations, the optical sensor is positioned away from the laser such the laser shines at the optical sensor, and when sheets enter the rotary die cutter they pass between the laser and the optical sensor thereby temporarily preventing the optical sensor from receiving the laser beam and indicating that a sheet is entering the rotary die cutter. In one embodiment, the optical sensor is positioned next to the laser such that the laser shines at a reflector that reflects the beam to the optical sensor. Sheet feed sensor 602 is connected to computer system 402. Layboy 104 includes top wheels 610, bottom wheels 614, motor 612 for driving top wheels 610 and motor 616 for driving bottom wheels 614. Motors 612 and 616 are connected to and controlled by computer system 402. Other forms of layboys can also be implemented including designs that feature belted arms over belted arms.

Transfer conveyor 106 includes belts 618, snubbing wheels 422 and motor 620 for driving belts 618. Snubbing wheels 422 are free rolling, riding on one or more blanks or belts 618 providing a light pressure, assisting with shingling of blanks on belts 618. Stacking conveyor 108 includes belts 622, snubbing wheels 420, hold down wheels 628, and motor 624 for driving belts 622. Snubbing wheels 420 are free rolling, riding on one or more blanks or belts 622 providing a light pressure, assisting with shingling of blanks on belts 622. Hold down wheels 628 are free rolling, riding on one or more blanks or belts 622, providing a light pressure, assisting with controlling the trajectory of the blanks as they enter stacker 110. Stacking conveyor 108 also includes lifting cylinder 626 for raising the downstream end of stacking conveyor 108 as the current stack gets taller. Motor 620, motor 624 and lifting cylinder 626 are connected to and controlled by computer system 402.

Stacker 110 includes discharge conveyor 114 to move a completed stack off the stacker. Discharge conveyor 114 is supported by optional discharge conveyor scissors lift 650, which moves discharge conveyor 114 up and down to assist with creating stacks. Discharge conveyor motor 652 and scissors lift 650 are connected to and controlled by computer system 402.

Figure 8:
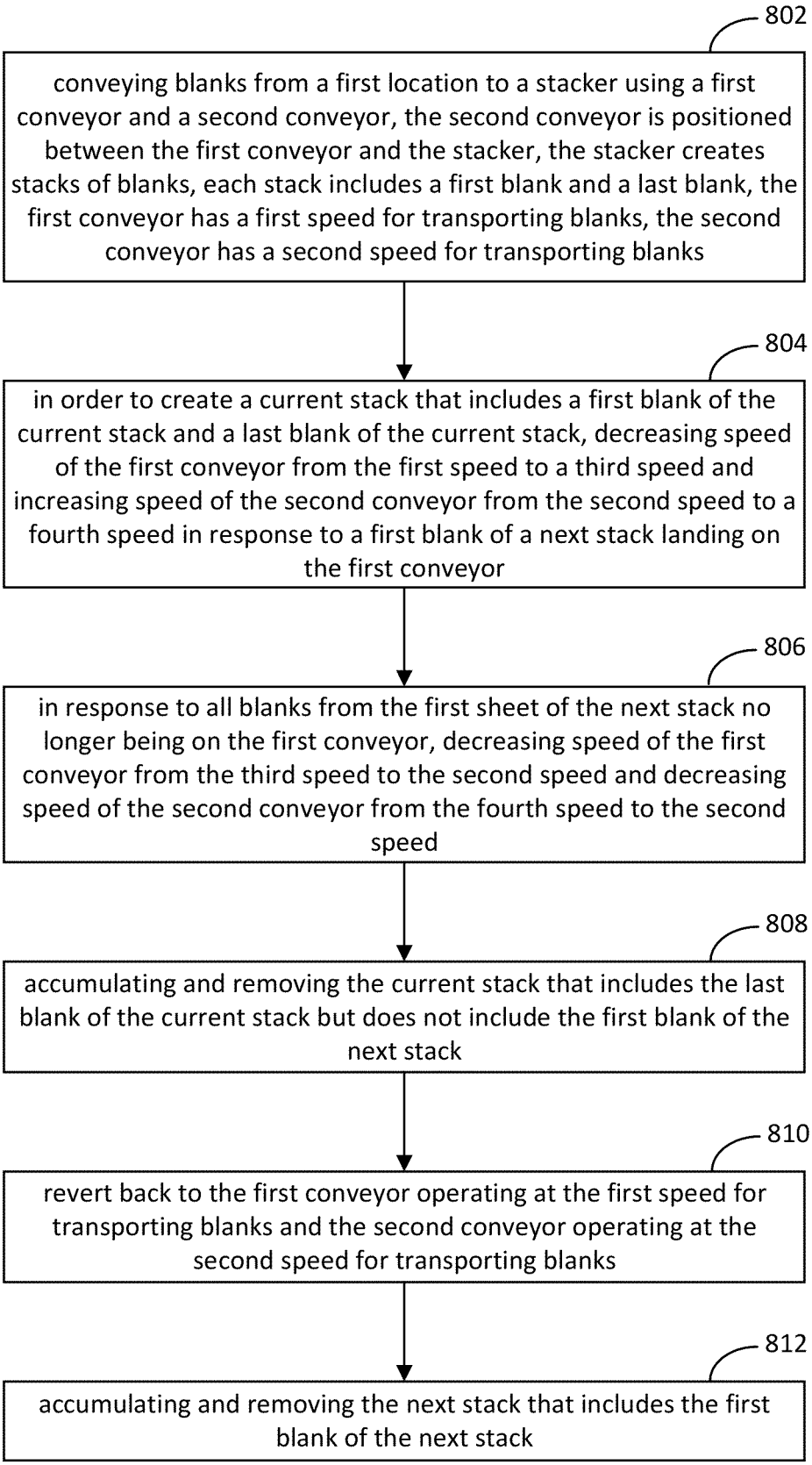
FIG. 8 is a flow chart describing one embodiment of a process for conveying blanks to the stacker that creates a big enough time gap between a last blank of a current stack and the first blank of the next stack to allow the stacker to discharge the current stack without interrupting the feed of new sheets.

FIG. 8 is a flow chart describing one embodiment of a process for conveying blanks to stacker 110 that creates a big enough time gap between a last blank of a current stack and the first blank of the next stack to allow the stacker to discharge the current stack without interrupting the feed of new sheets into the rotary die cutter for future stacks. In one embodiment, the process of FIG. 8 is performed at the direction of computer system 402.

Step 802 includes conveying blanks from a first location (e.g., rotary die cutter 102 and/or layboy 104) to stacker 110 using a first conveyor (e.g., transfer conveyor 106) and a second conveyor (e.g., stacking conveyor 108). The second conveyor is positioned between the first conveyor and stacker 110. The stacker creates stacks of blanks. Each stack includes a first blank and a last blank. The first conveyor transports blanks at a first speed. The second conveyor transports blanks at a second speed. In one embodiment, the second speed is different than the first speed. In another embodiment, the second speed is equal to the first speed.

Step 804 includes, in order to create a current stack that includes a first blank of the current stack and a last blank of the current stack, decreasing speed of the first conveyor from the first speed to a third speed and increasing speed of the second conveyor from the second speed to a fourth speed in response to a first blank of a next stack landing on the first conveyor. Step 806 includes, in response to all blanks from a first sheet of the next stack no longer being on the first conveyor, decreasing speed of the first conveyor from the third speed to the second speed and decreasing speed of the second conveyor from the fourth speed to the second speed. Step 808 includes accumulating and removing the current stack that includes the last blank of the current stack but does not include the first blank of the next stack. Step 810 includes reverting back to the first conveyor operating at the first speed for transporting blanks and the second conveyor operating at the second speed for transporting blanks. Step 812 includes accumulating and removing the next stack that includes the first blank of the next stack. In one embodiment steps 802-806 can be repeated for the next stack in conjunction with step 812.

Figure 9:
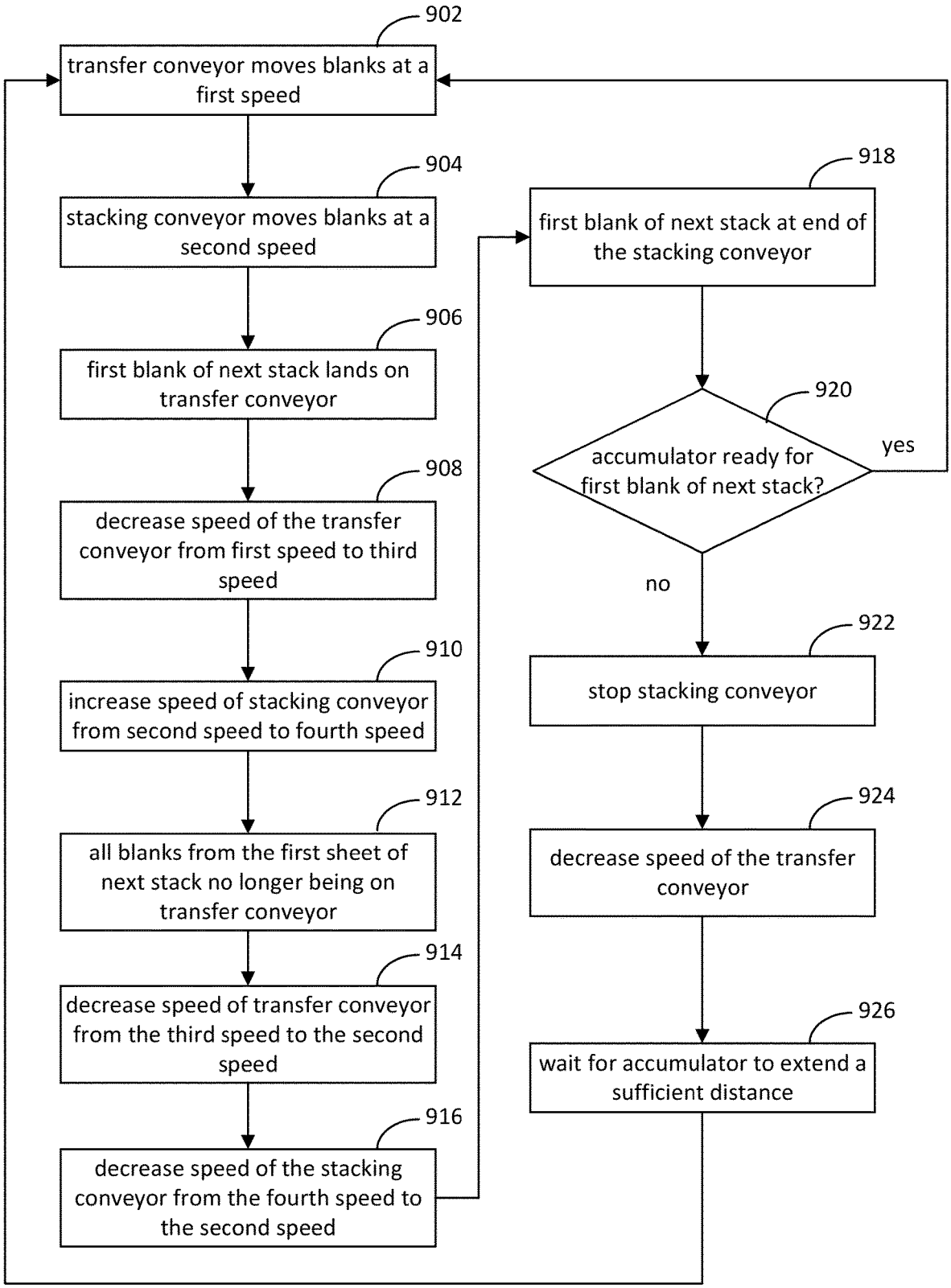
FIG. 9 is a flow chart describing one embodiment of a process for conveying blanks to the stacker that creates a big enough time gap between a last blank of a current stack and the first blank of the next stack to allow the stacker to discharge the current stack without interrupting the feed of new sheets.

FIG. 9 is a flow chart describing one embodiment of a process for conveying blanks to stacker 110 that creates a big enough time gap between a last blank of a current stack and the first blank of the next stack to allow the stacker to discharge the current stack without interrupting the feed of new sheets into the rotary die cutter for the future stacks. In one embodiment, the process of FIG. 9 is an example implementation of steps 802-810 of FIG. 8. In one embodiment, the process of FIG. 9 is performed at the direction of computer system 402.

In step 902 of FIG. 9, transfer conveyor 106 moves blanks at a first speed. In step 904, stacking conveyor 108 moves blanks at a second speed. The first speed and the second speed can be the same or different. In one embodiment, the second speed is slower than the first speed. In one embodiment, steps 902 and 904 reflect steady state mode, with the first speed and second speed being nominal speeds set up by the operator to be the fastest speeds for a safe and error free operation.

In step 906, the first blank of the next stack lands on transfer conveyor 906. In one embodiment, an operator chooses how many blanks high a stack will be. Additionally, an operator or machinery is used to load sheets into rotary die cutter 102. After the sheets leave the rotary die cutter, they are referred to as blanks and the blanks are transferred from rotary die cutter 102 to layboy 104. The blanks then travel across (or through) layboy 104 and are transferred to transfer conveyor 106. A blank lands on transfer conveyor 106 when it has been transferred to transfer conveyor 106. In another embodiment, a blank lands on transfer conveyor 106 when it first touches transfer conveyor 106 or first touches the top of the previous blank it is being shingled on top of the previous blank. In response to the first blank of the next stack landing on transfer conveyor 106, the speed of transfer conveyor 106 is decreased from the first speed to a third speed (step 908) and the speed of the stacking conveyor is increased from the second speed to a fourth speed (step 910). For purposes of this document, the speed of a conveyor is the speed of which it moves blanks (or other items). The speed of transfer conveyor 106 corresponds to surface speed of belts 618, which is controlled by motor 620. The speed of stacking conveyor 108 corresponds to the surface speed of belts 622, which is controlled by motor 624.

In step 912, all blanks from the first sheet of the next stack are no longer on transfer conveyor 106. A sheet becomes or results in one or more blanks after being operated on by rotary die cutter 102. The sheet that results in the blank that will be the first blank of the next stack is the first sheet of the next stack. One example of step 912 occurs when all blanks that result from the first sheet of the next stack have been transferred from transfer conveyor 106 to stacking conveyor 108 such that none of the blanks that result from the first sheet of the next stack remain on transfer conveyor 106. In response to all blanks from the first sheet of the next stack no longer being on transfer conveyor 106, the speed of transfer conveyor 106 is decreased from the third speed to the second speed (step 914) and the speed of stacking conveyor 108 is decreased from the fourth speed to the second speed (step 916). In another embodiment, decreasing the speed of transfer conveyor 106 in step 914 can include decreasing the speed to a stop. The above-described changing of speeds allows for stacker 110 to accumulate and discharge (remove) the current stack that includes the last blank of the current stack but does not include the first blank of the next stack.

In step 918, the first blank of the next stack reaches the end of stacking conveyor 108 (e.g., the end closest to stacker 110). If the accumulator 466 is ready for the first blank of the next stack (extended a sufficient distance) (step 920), then the process continues at step 902 for steady state operation. However, if the first blank of the next stack reaches the end of the second conveyor before accumulator 466 is ready for the first blank of the next stack (step 920), then stacking conveyor 108 is stopped (step 922) and the speed of transfer conveyor 106 is decreased or stopped (step 924). Steps 922 and 924 are performed to make sure that the first blank of the next stack is not put on the current stack or interferes with removing/discharging the current stack by falling below the accumulator 466 or potentially under backstop lip 462. The system then waits for accumulator 466 to extend a sufficient distance in step 926. In response to accumulator 466 extending a sufficient distance (step 926), the process continues at step 902 so that transfer conveyor 106 returns to the first speed in step 902 and stacking conveyor 108 returns to the second speed in step 904.

Figure 10:
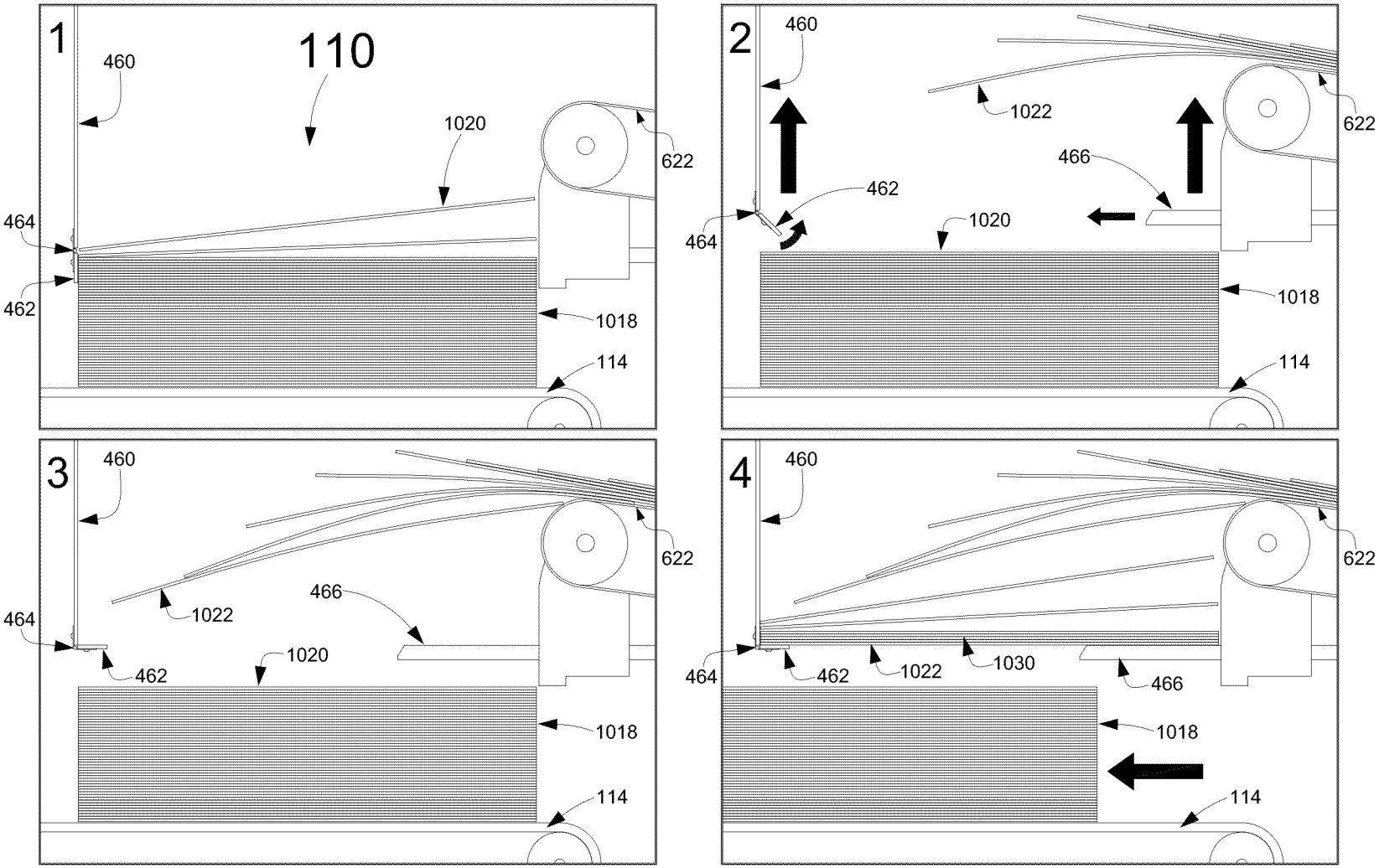
FIG. 10 depicts the stacker at four different conditions during the process of FIG. 9.

FIG. 10 includes four panels (1, 2, 3, 4) that depict stacker 110 at four different conditions during the process of FIG. 9. Panel 1 shows the current stack 1018 of blanks being assembled on top of discharge conveyor 114. At the point in time of Panel 1, blank 1020 (which is the last blank of the current stack) has just left belts 622 of stacking conveyor 108 and is falling on top of the current stack 1018. Note that computer system 402 has caused hinge 464 to position back stop lip 462 at 180° in relation to back stop 460. Accumulator 466 is fully recessed.

In Panel 2 and Panel 3 of FIG. 10, stacker 110 is preparing to discharge (remove) current stack 1018. In Panel 2, back stop 460, hinge 464, backstop lip 462, belts 622, and accumulator 466 all have been raised by lifting cylinder 626 (not shown). The purpose of this rise is to allow space for the motion of the backstop lip 462 and accumulator 466 without contacting the current stack. This space needed above the current stack for the backstop lip 462 and accumulator 466 might also be accomplished by instead lowering discharge conveyor 114 with scissors lift 650 (not shown). In Panel 2, back stop lip 462 is being rotated about hinge 464. Also in Panel 2, blanks for the next stack are stopped on stacking conveyor 108 and accumulator 466 is being extended to catch and support the blanks of the next stack. In Panel 3, computer system 402 has caused hinge 464 to position back stop lip 462 at 90° in relation to back stop 460 and accumulator 466 is fully extended to catch and support the blanks of the next stack. The first blank 1022 of the next stack will land directly on accumulator 466 and back stop lip 462. In one embodiment, the technology described herein is used to generate more time after Panel 1 and prior to Panel 3 so that the feed of new sheets into the rotary die cutter does not need to be interrupted.

Panel 4 of FIG. 10 shows discharge conveyor 114 starting to remove current stack 1018 from stacker 110. Back stop lip 462 is positioned at 90° in relation to back stop 460 and accumulator 466 is fully extended such that back stop lip 462 and accumulator 466 both (together) catch and support the blanks of the next stack 1030.

After current stack 1018 is moved away: back stop 460, hinge 464, backstop lip 462, belts 622, and accumulator 466 will be lowered by lifting cylinder 626 to a small distance above discharge conveyor 114. Alternatively, or additionally scissors lift 650 may raise discharge conveyor 114 to achieve the same small distance needed. Back stop lip 462 is rotated to be at 180° in relation to back stop 460 while accumulator 466 is simultaneously retracted (similar to Panel 1). At this time next stack 1030 is dropped on discharge conveyor 114 and stacking continues. At this time the next stack already has several blanks in it due to accumulation of blanks before and after Panel 4 on the accumulator 466.

Figure 11:
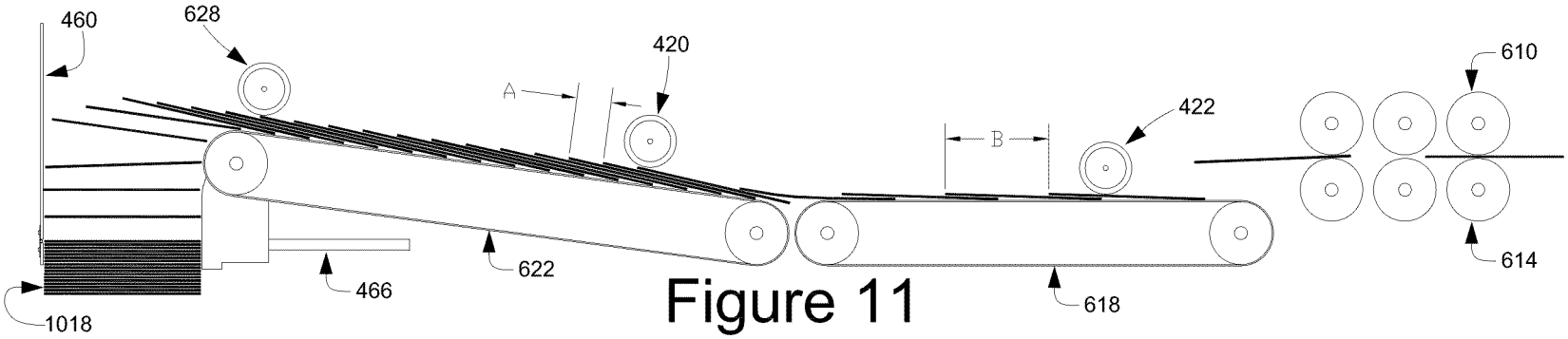
FIGS. 11-16 depicts the transfer conveyor and the stacking conveyor at different times during the process of FIG. 9.

FIGS. 11-16 depict transfer conveyor 106 and the stacking conveyor 108 at different times during the process of FIG. 9. For example, FIG. 11 depicts transfer conveyor 106 and the stacking conveyor 108 after step 904 and prior to step 906 of FIG. 9. FIG. 11 shows blanks on belts 622 of stacking conveyor 108 shingled at a single distance A and blanks on belts 618 of transfer conveyor 106 shingled at a single distance B, where B>A. Thus, in the example of FIG. 11, the speed of stacking conveyor 108 (second speed) is slower than the speed of transfer conveyor 106 (first speed).

Figure 12:
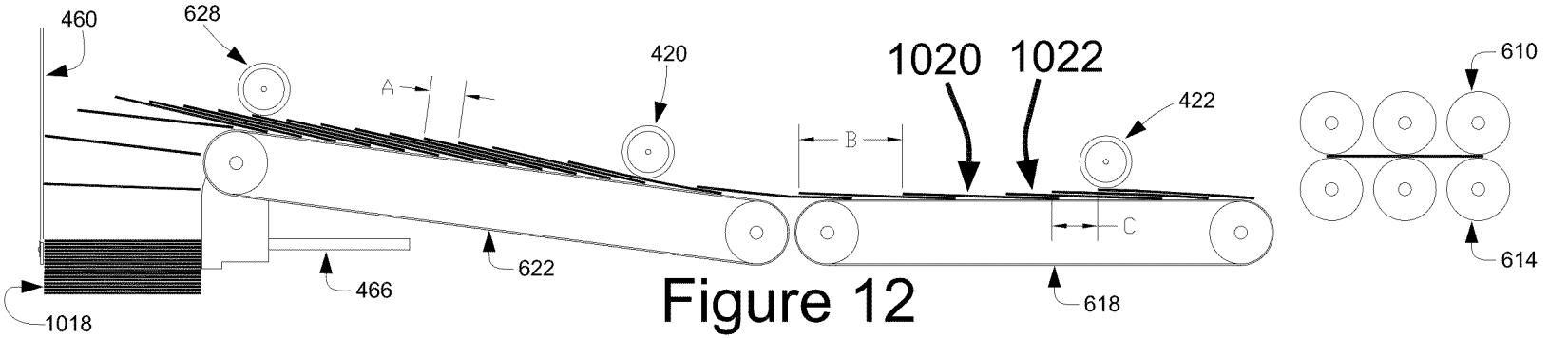

FIG. 12 depicts transfer conveyor 106 and the stacking conveyor 108 after step 908 of FIG. 9. The first blank 1022 of the next stack is on transfer conveyor 106 and the speed of transfer conveyor 106 has been decreased. The last blank 1020 of the current stack is also on transfer conveyor 106. Because the speed of transfer conveyor 106 has been decreased, blanks on belts 622 of stacking conveyor 108 are now shingled at a single distance C, where C<B.

Figure 13:
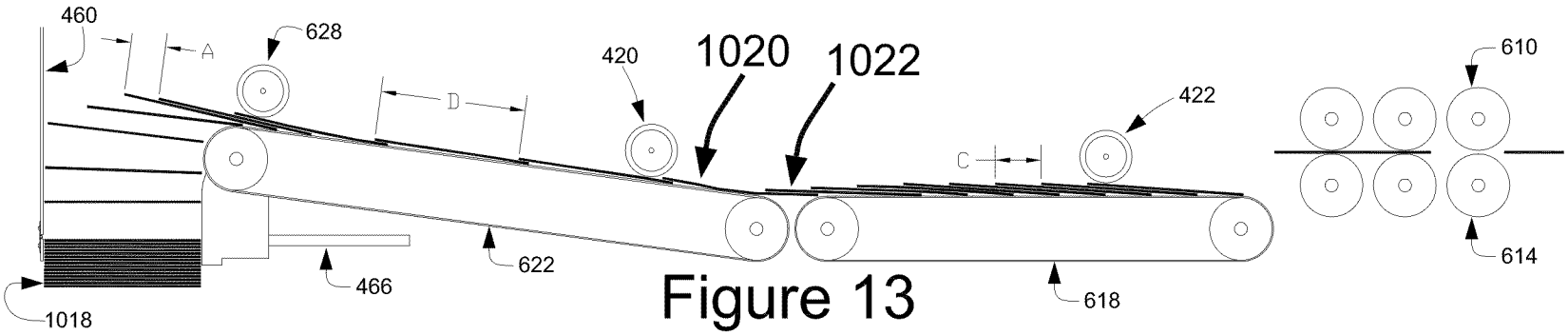

FIG. 13 depicts transfer conveyor 106 and the stacking conveyor 108 after step 910 of FIG. 9. The speed of stacking conveyor 108 has been increased; therefore, blanks on belts 622 of stacking conveyor 108 are shingled at a single distance D, where D>A and D>B.

Figure 14:
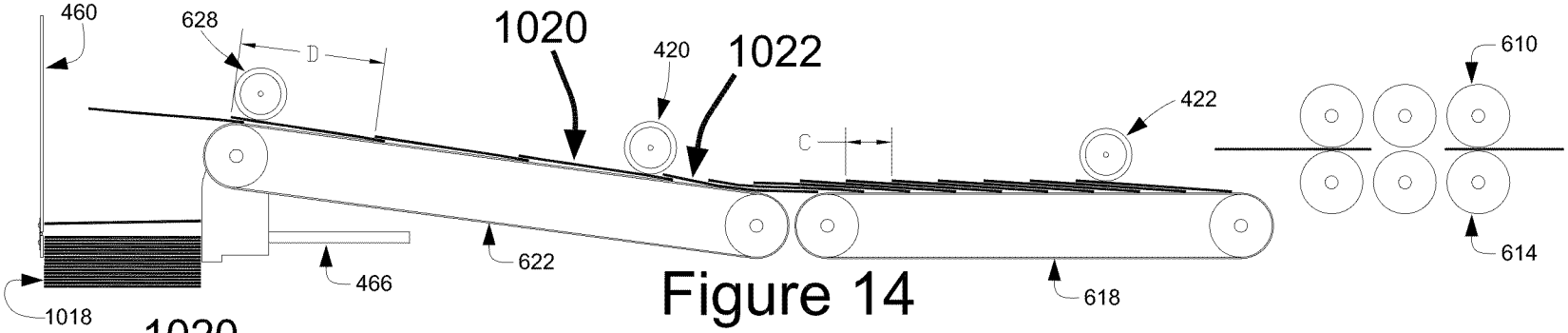

FIG. 14 depicts transfer conveyor 106 and the stacking conveyor 108 at step 912 of FIG. 9. All blanks from the first sheet of the next stack, which in this example comprises the blank 1022, are no longer on transfer conveyor 106 because they are no longer touching belts 618 on transfer conveyor 106.

Figure 15:
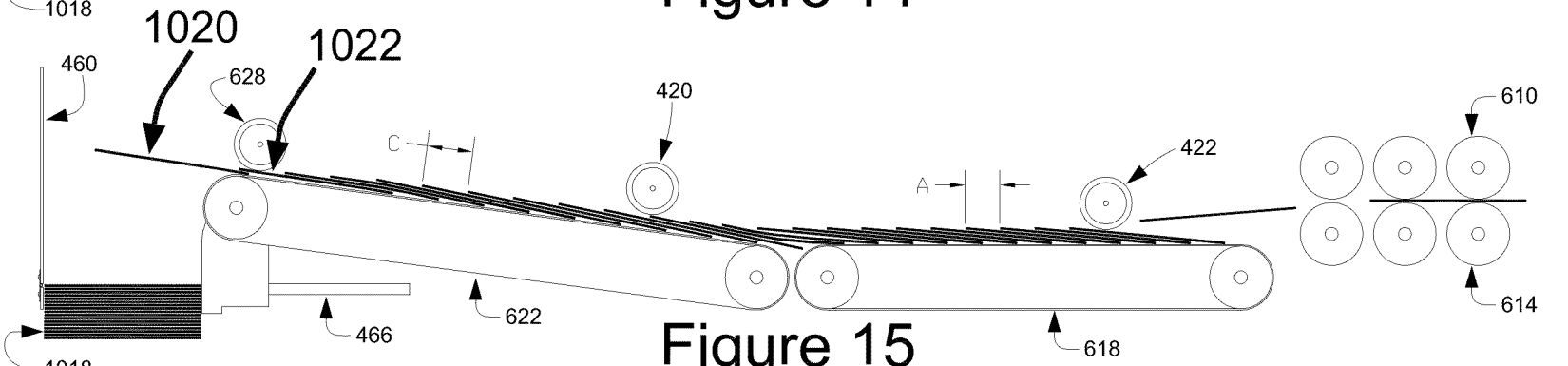

FIG. 15 depicts transfer conveyor 106 and the stacking conveyor 108 after step 916 of FIG. 9. The speed of belts 622 of stacking conveyor 108 and the speed of belts 618 of transfer conveyor 106 have been decreased in steps 914 and 916 to the same speed used for stacking conveyor 108 during step 904. That is, belts 622 of stacking conveyor 108 and belts 618 of transfer conveyor 106 are both operating at the second speed. As a result of this decrease in speed, the shingle distance of new blanks landing on belts 618 of transfer conveyor 106 is A. Because the speed of belts 622 of stacking conveyor 108 is the same as the speed of belts 618 of transfer conveyor 106, the shingle distance does not change for boxes transitioning from belts 618 of transfer conveyor 106 to belts 622 of stacking conveyor 108, which explains why blanks already on belts 622 of stacking conveyor 108 at shingle distance C remain at shingle distance C. FIG. 15 also shows the moment when the last blank 1020 of the current stack is at the end of stacking conveyor 108.

Figure 16:
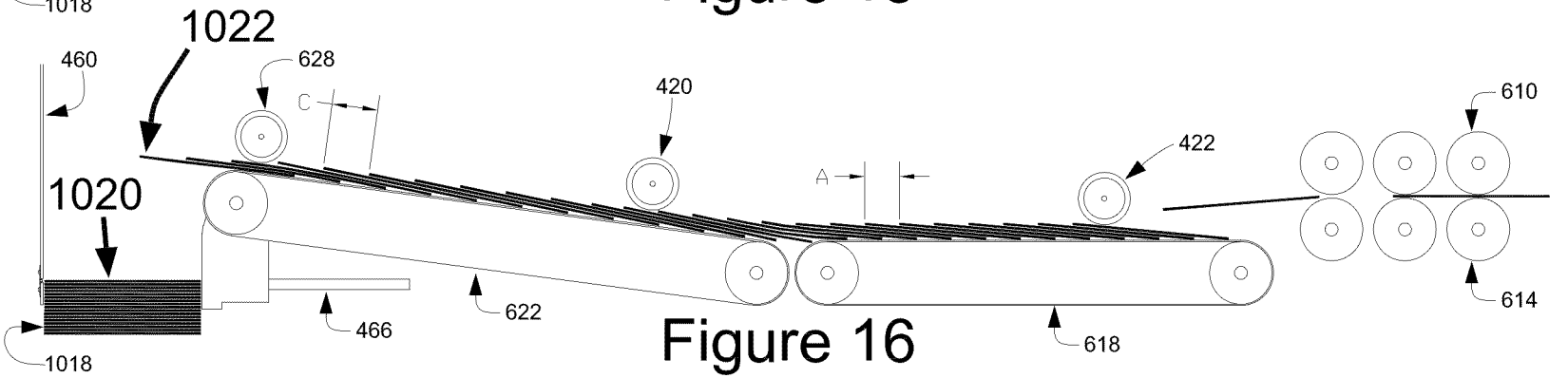

FIG. 16 depicts transfer conveyor 106 and the stacking conveyor 108 at step 918 of FIG. 9. The first blank 1022 of the next stack is at the end of stacking conveyor 108 (e.g., at the end of belts 622 of stacking conveyor 108). The last blank 1020 of the current stack is now on the current stack 1018. As drawn in FIG. 16, accumulator 466 is not ready for the first blank 1022 since it is not extended due to stack 1018 being in the way. Step 920 would return a 'no' and the stacking conveyor 108 and belts 622 would soon stop (step 922). First blank 1022 is held in place on stacking conveyor 108 by hold down wheels 628.

Figure 17:
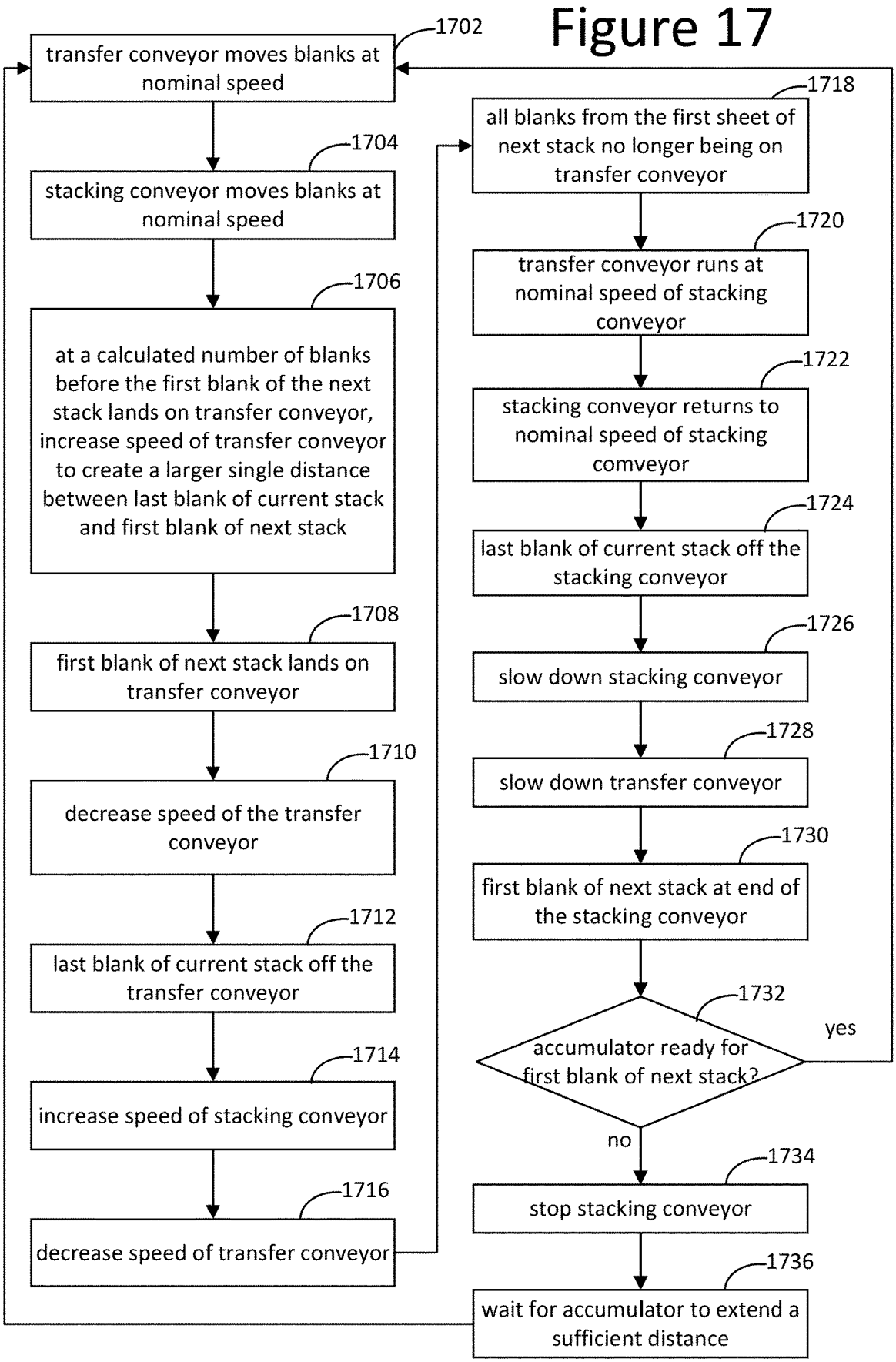
FIG. 17 is a flow chart describing one embodiment of a process for conveying blanks to the stacker that creates a big enough time gap between a last blank of a current stack and the first blank of the next stack to allow the stacker to discharge the current stack without interrupting the feed of new sheets.

FIG. 17 is a flow chart describing one embodiment of a process for conveying blanks to stacker 110 that creates a big enough time gap between a last blank of a current stack and the first blank of the next stack to allow the stacker to discharge the current stack without interrupting the feed of new sheets into the rotary dies cutter for future stacks. In one embodiment, the process of FIG. 17 is performed at the direction of computer system 402.

In step 1702 of FIG. 17, transfer conveyor 106 moves blanks at a nominal speed for transfer conveyor 106. In step 1704, stacking conveyor 108 moves blanks at a nominal speed for stacking conveyor 108. The nominal speed for transfer conveyor 106 and the nominal speed for stacking conveyor 108 can be the same or different.

In step 1706, at a calculated number of blanks before the first blank of the next stack lands on transfer conveyor 106, the speed of transfer conveyor 106 is increased to create a larger single distance between last blank of the current stack and first blank of the next stack. In step 1708, the first blank of the next stack lands on transfer conveyor 106. In step 1710, in response to the first blank of the next stack landing on transfer conveyor 106, the speed of transfer conveyor 106 is decreased (resulting in a smaller shingle distance). In step 1712, the last blank of the current stack is off of transfer conveyor 106. In step 1714, in response to the last blank of the current stack being off of transfer conveyor 106, the speed of stacking conveyor 108 is increased (causing stacking conveyor 108 to 108 make a large shingle distance). In step 1716, in response to the last blank of the current stack being off of transfer conveyor 106, the speed of transfer conveyor 106 is decreased. In step 1718, all blanks of the first sheet of the next stack are no longer on transfer conveyor 106. In response to all blanks of the first sheet of the next stack no longer being on transfer conveyor 106, transfer conveyor 106 runs at the nominal speed of the stacking conveyor 108 (step 1720) and stacking conveyor 108 runs at the nominal speed of the stacking conveyor 108 (step 1722). In step 1724, the last blank of the current stack is off of stacking conveyor 108. In response to the last blank of the current stack being off of stacking conveyor 108, the speed of stacking conveyor 108 is decreased (step 1726) and the speed of transfer conveyor 106 is decreased (step 1728).

In step 1730, the first blank of the next stack reaches the end of stacking conveyor 108 (e.g., the end closest to stacker 110). If the accumulator 466 is ready for the first blank of the next stack (extended a sufficient distance) (step 1732), then process continues at step 1702 for steady state operation. However, if the first blank of the next stack reaches the end of the stacking conveyor 108 before the accumulator 466 is ready for the first blank of the next stack (step 1732), then stacking conveyor 108 is stopped (step 1734) and the system waits for the accumulator 466 to extend a sufficient distance in step 1736. The process continues at step 1702 so that transfer conveyor 106 operates at its nominal speed in step 1702 and stacking conveyor 108 operates at its nominal speed in step 1704.

A system for conveying blanks to a stacker has been described that creates a big enough time gap between a last blank of a current stack and the first blank of the next stack to allow the stacker to discharge the current stack without interrupting the feed of new sheets/blanks for the next stack.

One embodiment includes an apparatus for conveying and stacking, comprising: a first conveyor, the first conveyor is configured to move blanks; a second conveyor downstream from the first conveyor, the second conveyor is configured to move blanks; a stacker downstream from the second conveyor, the stacker is configured to create stacks of blanks, each stack includes a first blank and a last blank such that a current stack includes a first blank of the current stack and a last blank of the current stack and a next stack includes a first blank of the next stack and a last blank of the next stack; and one or more processors connected to the first conveyor and the second conveyor. The one or more processors are configured to: decrease speed of the first conveyor in response to a first blank of a next stack landing on the first conveyor, and decrease speed of the second conveyor in response to all blanks from the first sheet of the next stack no longer being on the first conveyor so that the stacker can accumulate and remove the current stack that includes the last blank of the current stack but does not include the first blank of the next stack.

In one example implementation, the one or more processors are configured to increase speed of the second conveyor in response to the first blank of the next stack landing on the first conveyor.

In one example implementation, the one or more processors are configured to decrease speed of the first conveyor in response to all blanks from the first sheet of the next stack no longer being on the first conveyor.

In one example implementation, the first conveyor is configured to move blanks at a first speed; the second conveyor is configured to move blanks at a second speed; and the one or more processors are configured to: decrease speed of the first conveyor from the first speed to a third speed and increase speed of the second conveyor from the second speed to a fourth speed in response to the first blank of the next stack landing on the first conveyor, and decrease speed of the first conveyor from the third speed to the second speed and decrease speed of the second conveyor from the fourth speed to the second speed in response to all blanks from the first sheet of the next stack no longer being on the first conveyor so that the stacker accumulates and removes the current stack that includes the last blank of the current stack but does not include the first blank of the next stack.

In one example implementation, the first blank of the next stack and the last blank of the current stack are both positioned on the first conveyor when the one or more processors decrease speed of the first conveyor from the first speed to the third speed and increase speed of the second conveyor from the second speed to the fourth speed in response to the first sheet of the next stack landing on the first conveyor.

In one example implementation, the stacker is configured to accumulate and remove the next stack after the stacker accumulates and removes the current stack.

In one example implementation, the first conveyor is configured to shingle blanks received at the first conveyor; and the second conveyor is configured to shingle blanks received at the second conveyor.

In one example implementation, the first conveyor is configured to shingle blanks received at the first conveyor at a first shingle distance in a first mode; the first conveyor is configured to move sheets at the first speed in the first mode; and the second conveyor is configured to move sheets at the second speed in the first mode.

In one example implementation, the first conveyor and the second conveyor are configured to transition to a second mode in response to the first blank of the next stack landing on the first conveyor; the first conveyor and the second conveyor are configured to transition to a third mode in response to all blanks from the first sheet of the next stack no longer being on the first conveyor; the first conveyor is configured to transport sheets at the third speed in the second mode; the second conveyor is configured to transport sheets at the fourth speed in the second mode; and in the second mode, the first conveyor is configured to shingle blanks received at the first conveyor at a second shingle distance and the second conveyor is configured to shingle sheets received at the second conveyor at a third shingle distance, the second shingle distance is smaller than the first shingle distance, the third shingle distance is larger than the first shingle distance.

One example implementation further comprises a set of snubbing wheels positioned above the second conveyor at the entrance of the second conveyor.

One example implementation further comprises a group of snubbing wheels positioned above the first conveyor at the entrance of the first conveyor.

One example implementation further comprises a sheet feed sensor connected to the one or more processors, the sheet feed sensor is configured to indicate presence of a sheet at a rotary die cutter upstream from the first conveyor, one or more processors are configured to use the indications of presence of a sheet in combination with length and speed of the first conveyor and the second conveyor to track position of the first blank of the next stack.

One example implementation further comprises a layboy positioned upstream from the first conveyor, the layboy receives the sheets from a rotary die cutter, the layboy is configured to transport blanks to the first conveyor and remove scrap from the blanks, the first conveyor is configured to transport blanks to the second conveyor, the second conveyor is configured to transport blanks to the stacker, the rotary die cutter creates blanks from sheets.

In one example implementation, the one or more processors are further configured to: in response to the first blank of the next stack reaching an end of the second conveyor before the stacker is ready for the first blank of the next stack, stop the second conveyor; and in response to the stacker accumulator extending, run the first conveyor at the first speed and run the second conveyor at the second speed.

In one example implementation, the first conveyor and the second conveyor include separate motors and separate belts driven by wheels that are actuated by the respective separate motors.

In one example implementation, the first conveyor is configured to move blanks at a first nominal speed; the second conveyor is configured to move blanks at a second nominal speed; and the one or more processors are configured to: increase speed of the first conveyor when a predetermined number of blanks prior to the first blank of the next stack have landed on the first conveyor, decrease speed of the first conveyor in response to the first blank of the next stack landing on the first conveyor, increase speed of the second conveyor and decrease speed of the second conveyor in response to a last blank of the current stack no longer being on the first conveyor, run the second conveyor at the second nominal speed in response to all blanks from a first sheet of the next stack no longer being on the first conveyor, and slow down the second conveyor in response to the last blank of the current stack being off the stacking conveyor so that the stacker accumulates and removes the current stack that includes the last blank of the current stack but does not include the first blank of the next stack.

In one example implementation, the one or more processors are further configured to: in response to the first sheet of the next stack reaching an end of the second conveyor before the stacker is ready for the first blank of the next stack, stop the second conveyor; and in response to the stacker accumulator extending, operate the first conveyor at the first nominal speed and the second conveyor to the second nominal speed.

In one example implementation, the first conveyor is configured to shingle blanks received at the first conveyor; the increasing speed of the first conveyor when a predetermined number of blanks prior to the first blank of the next stack have landed on the first conveyor comprises increasing the shingle distance of blanks that are shingled by the first conveyor; and the decreasing speed of the first conveyor in response to the first blank of the next stack landing on the first conveyor comprises decreasing the shingle distance of blanks that are shingled by the first conveyor.

In one example implementation, the first blank of the next stack and the last blank of the current stack are both positioned on the first conveyor when the one or more processors decrease speed of the first conveyor in response to the first blank of a next stack landing on the first conveyor.

One example implementation further comprises a sheet feed sensor connected to the one or more processors, the sheet feed sensor is configured to indicate presence of a sheet at a rotary die cutter upstream from the first conveyor, one or more processors are configured to use the indications of presence of a sheet in combination with length and speed of the first conveyor and the second conveyor to track position of the first blank of the next stack.

One embodiment includes an apparatus for conveying and stacking, comprising: a first conveyor, the first conveyor is configured to shingle blanks received at the first conveyor at a first shingle distance in a first mode; a second conveyor, the first conveyor delivers blanks to the second conveyor, the second conveyor is configured to shingle blanks received at the second conveyor; and a stacker, the second conveyor delivers blanks to the stacker, the stacker is configured to create stacks of blanks, each stack includes a first blank and a last blank such that a current stack includes a first blank of the current stack and a last blank of the current stack and a next stack includes a first blank of the next stack and a last blank of the next stack; in response to a first blank of the next stack landing on the first conveyor, the first conveyor is configured to enter a second mode in which the first conveyor shingles blanks received at the first conveyor at a second shingle distance and the second conveyor is configured to enter the second mode in order to shingle blank received at the second conveyor at a third shingle distance, the second shingle distance is smaller than the first shingle distance, the third shingle distance is larger than the first shingle distance; and in response to all blanks from the first sheet of the next stack no longer being on the first conveyor, the second conveyor is configured to slow down.

One embodiment includes methods for creating stacks of sheets, comprising: conveying blanks from a first location to a stacker using a first conveyor and a second conveyor, the second conveyor is positioned between the first conveyor and the stacker, the stacker creates stacks of blanks, each stack includes a first blank and a last blank, the first conveyor transporting blanks at a first speed, the second conveyor transporting blanks at a second speed; in order to create a current stack that includes a first blank of the current stack and a last blank of the current stack, decreasing speed of the first conveyor from the first speed to a third speed and increasing speed of the second conveyor from the second speed to a fourth speed in response to a first blank of a next stack landing on the first conveyor; in response to all blanks from a first sheet of the next stack no longer being on the first conveyor, decreasing speed of the first conveyor from the third speed to the second speed and decreasing speed of the second conveyor from the fourth speed to the second speed; accumulating and removing the current stack that includes the last blank of the current stack but does not include the first blank of the next stack; and accumulating and removing the next stack that includes the first blank of the next stack.

In one example implementation, the first blank of the next stack and the last blank of the current stack are both positioned on the first conveyor when performing the decreasing speed of the first conveyor from the first speed to the third speed and increasing speed of the second conveyor from the second speed to the fourth speed in response to the first blank of the next stack landing on the first conveyor.

In one example implementation, the first conveyor transporting blanks at the first speed includes the first conveyor shingling sheets received at the first conveyor with a first shingle distance; the decreasing speed of the first conveyor from the first speed to a third speed includes the first conveyor shingling sheets received at the first conveyor with a second shingle distance that is smaller than the first shingle distance; and the increasing speed of the second conveyor from the second speed to the fourth speed includes the second conveyor shingling sheets received at the second conveyor with a third shingle distance that is larger than the first shingle distance.

For purposes of this document, reference in the specification to "an embodiment," "one embodiment," "some embodiments," or "another embodiment" may be used to describe different embodiments or the same embodiment.

For purposes of this document, a connection may be a direct connection or an indirect connection (e.g., via one or more other parts). In some cases, when an element is referred to as being connected or coupled to another element, the element may be directly connected to the other element or indirectly connected to the other element via intervening elements. When an element is referred to as being directly connected to another element, then there are no intervening elements between the element and the other element. Two devices are "in communication" if they are directly or indirectly connected so that they can communicate electronic signals between them.

For purposes of this document, the term "based on" may be read as "based at least in part on."

For purposes of this document, without additional context, use of numerical terms such as a "first" object, a "second" object, and a "third" object may not imply an ordering of objects, but may instead be used for identification purposes to identify different objects.

For purposes of this document, the term "set" of objects may refer to a "set" of one or more of the objects.

The foregoing detailed description has been presented for purposes of illustration and description. It is not intended to be exhaustive or to limit the technology described herein to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated.

What is claimed is:

1. An apparatus for conveying and stacking, comprising:

a first conveyor, the first conveyor is configured to move blanks;

a second conveyor downstream from the first conveyor, the second conveyor is configured to move blanks;

a stacker downstream from the second conveyor, the stacker is configured to create stacks of blanks, each stack includes a first blank and a last blank such that a current stack includes a first blank of the current stack and a last blank of the current stack and a next stack includes a first blank of the next stack and a last blank of the next stack; and one or more processors connected to the first conveyor and the second conveyor, the one or more processors are configured to:

decrease speed of the first conveyor in response to the first blank of the next stack landing on the first conveyor, and decrease speed of the second conveyor in response to all one or more blanks from a first sheet of the next stack no longer being on the first conveyor so that the stacker can accumulate and remove the current stack that includes the last blank of the current stack but does not include the first blank of the next stack.

2. The apparatus of claim 1, wherein:

the one or more processors are configured to increase speed of the second conveyor in response to the first blank of the next stack landing on the first conveyor.

3. The apparatus of claim 2, wherein:

the one or more processors are configured to decrease speed of the first conveyor in response to all one or more blanks from the first sheet of the next stack no longer being on the first conveyor.

4. The apparatus of claim 3, wherein:

the first conveyor is configured to move blanks at a first speed;

the second conveyor is configured to move blanks at a second speed; and the one or more processors are configured to:

decrease speed of the first conveyor from the first speed to a third speed and increase speed of the second conveyor from the second speed to a fourth speed in response to the first blank of the next stack landing on the first conveyor, and decrease speed of the first conveyor from the third speed to the second speed and decrease speed of the second conveyor from the fourth speed to the second speed in response to all one or more blanks from the first sheet of the next stack no longer being on the first conveyor so that the stacker accumulates and removes the current stack that includes the last blank of the current stack but does not include the first blank of the next stack.

5. The apparatus of claim 4, wherein:

the first blank of the next stack and the last blank of the current stack are both positioned on the first conveyor when the one or more processors decrease speed of the first conveyor from the first speed to the third speed and increase speed of the second conveyor from the second speed to the fourth speed in response to the first blank of the next stack landing on the first conveyor.

6. The apparatus of claim 4, wherein:

the stacker is configured to accumulate and remove the next stack after the stacker accumulates and removes the current stack.

7. The apparatus of claim 4, wherein:

the first conveyor is configured to shingle blanks received at the first conveyor; and the second conveyor is configured to shingle blanks received at the second conveyor.

8. The apparatus of claim 4, wherein:

the first conveyor is configured to shingle blanks received at the first conveyor at a first shingle distance in a first mode;

the first conveyor is configured to move sheets at the first speed in the first mode; and the second conveyor is configured to move sheets at the second speed in the first mode.

9. The apparatus of claim 8, wherein:

the first conveyor and the second conveyor are configured to transition to a second mode in response to the first blank of the next stack landing on the first conveyor;

the first conveyor and the second conveyor are configured to transition to a third mode in response to all one or more blanks from the first sheet of the next stack no longer being on the first conveyor;

the first conveyor is configured to transport sheets at the third speed in the second mode;

the second conveyor is configured to transport sheets at the fourth speed in the second mode; and in the second mode, the first conveyor is configured to shingle blanks received at the first conveyor at a second shingle distance and the second conveyor is configured to shingle sheets received at the second conveyor at a third shingle distance, the second shingle distance is smaller than the first shingle distance, the third shingle distance is larger than the first shingle distance.

10. The apparatus of claim 4, further comprising:

a set of snubbing wheels positioned above the second conveyor at the entrance of the second conveyor.

11. The apparatus of claim 10, further comprising:

a group of snubbing wheels positioned above the first conveyor at the entrance of the first conveyor.

12. The apparatus of claim 4, further comprising:

a sheet feed sensor connected to the one or more processors, the sheet feed sensor is configured to indicate presence of a sheet at a rotary die cutter upstream from the first conveyor, one or more processors are configured to use the indications of presence of a sheet in combination with length and speed of the first conveyor and the second conveyor to track position of the first blank of the next stack.

13. The apparatus of claim 4, further comprising:

a layboy positioned upstream from the first conveyor, the layboy receives the sheets from a rotary die cutter, the layboy is configured to transport blanks to the first conveyor and remove scrap from the blanks, the first conveyor is configured to transport blanks to the second conveyor, the second conveyor is configured to transport blanks to the stacker, the rotary die cutter creates blanks from sheets.

14. The apparatus of claim 4, wherein the one or more processors are further configured to:

in response to the first blank of the next stack reaching an end of the second conveyor before the stacker is ready for the first blank of the next stack, stop the second conveyor; and in response to the stacker accumulator extending, run the first conveyor at the first speed and run the second conveyor at the second speed.

15. The apparatus of claim 4, wherein:

the first conveyor and the second conveyor include separate motors and separate belts driven by wheels that are actuated by the respective separate motors.

16. The apparatus of claim 1, wherein:

the first conveyor is configured to move blanks at a first nominal speed;

the second conveyor is configured to move blanks at a second nominal speed; and the one or more processors are configured to:

increase speed of the first conveyor when a predetermined number of blanks prior to the first blank of the next stack have landed on the first conveyor, decrease speed of the first conveyor in response to the first blank of the next stack landing on the first conveyor, increase speed of the second conveyor and decrease speed of the second conveyor in response to a last blank of the current stack no longer being on the first conveyor, run the second conveyor at the second nominal speed in response to all one or more blanks from a first sheet of the next stack no longer being on the first conveyor, and slow down the second conveyor in response to the last blank of the current stack being off the stacking conveyor so that the stacker accumulates and removes the current stack that includes the last blank of the current stack but does not include the first blank of the next stack.

17. The apparatus of claim 16, wherein the one or more processors are further configured to:

in response to the first sheet of the next stack reaching an end of the second conveyor before the stacker is ready for the first blank of the next stack, stop the second conveyor; and in response to the stacker accumulator extending, operate the first conveyor at the first nominal speed and the second conveyor to the second nominal speed.

18. The apparatus of claim 16, wherein:

the first conveyor is configured to shingle blanks received at the first conveyor;

the increasing speed of the first conveyor when a predetermined number of blanks prior to the first blank of the next stack have landed on the first conveyor comprises increasing the shingle distance of blanks that are shingled by the first conveyor; and the decreasing speed of the first conveyor in response to the first blank of the next stack landing on the first conveyor comprises decreasing the shingle distance of blanks that are shingled by the first conveyor.

19. The apparatus of claim 16, wherein:

the first blank of the next stack and the last blank of the current stack are both positioned on the first conveyor when the one or more processors decrease speed of the first conveyor in response to the first blank of a next stack landing on the first conveyor.

20. The apparatus of claim 16, further comprising:

a sheet feed sensor connected to the one or more processors, the sheet feed sensor is configured to indicate presence of a sheet at a rotary die cutter upstream from the first conveyor, one or more processors are configured to use the indications of presence of a sheet in combination with length and speed of the first conveyor and the second conveyor to track position of the first blank of the next stack.

21. An apparatus for conveying and stacking, comprising:

a first conveyor, the first conveyor is configured to shingle blanks received at the first conveyor at a first shingle distance in a first mode;

a second conveyor, the first conveyor delivers blanks to the second conveyor, the second conveyor is configured to shingle blanks received at the second conveyor; and a stacker, the second conveyor deliver blanks to the stacker, the stacker is configured to create stacks of blanks, each stack includes a first blank and a last blank such that a current stack includes a first blank of the current stack and a last blank of the current stack and a next stack includes a first blank of the next stack and a last blank of the next stack;

in response to a first blank of the next stack landing on the first conveyor, the first conveyor is configured to enter a second mode in which the first conveyor shingles blanks received at the first conveyor at a second shingle distance and the second conveyor is configured to enter the second mode in order to shingle blanks received at the second conveyor at a third shingle distance, the second shingle distance is smaller than the first shingle distance, the third shingle distance is larger than the first shingle distance; and in response to all blanks from a first sheet of the next stack no longer being on the first conveyor, the second conveyor is configured to slow down.

22. A method for creating stacks of sheets, comprising:

conveying blanks from a first location to a stacker using a first conveyor and a second conveyor, the second conveyor is positioned between the first conveyor and the stacker, the stacker creates stacks of blanks, each stack includes a first blank and a last blank, the first conveyor transporting blanks at a first speed, the second conveyor transporting blanks at a second speed;

in order to create a current stack that includes a first blank of the current stack and a last blank of the current stack, decreasing speed of the first conveyor from the first speed to a third speed and increasing speed of the second conveyor from the second speed to a fourth speed in response to a first blank of a next stack landing on the first conveyor;

in response to all one or more blanks from a first sheet of the next stack no longer being on the first conveyor, decreasing speed of the first conveyor from the third speed to the second speed and decreasing speed of the second conveyor from the fourth speed to the second speed;

accumulating and removing the current stack that includes the last blank of the current stack but does not include the first blank of the next stack; and accumulating and removing the next stack that includes the first blank of the next stack.

23. The method of claim 22, wherein the first blank of the next stack and the last blank of the current stack are both positioned on the first conveyor when performing the decreasing speed of the first conveyor from the first speed to the third speed and increasing speed of the second conveyor from the second speed to the fourth speed in response to the first blank of the next stack landing on the first conveyor.

24. The method of claim 22, wherein:

the first conveyor transporting blanks at the first speed includes the first conveyor shingling sheets received at the first conveyor with a first shingle distance;

the decreasing speed of the first conveyor from the first speed to the third speed includes the first conveyor shingling sheets received at the first conveyor with a second shingle distance that is smaller than the first shingle distance; and the increasing speed of the second conveyor from the second speed to the fourth speed includes the second conveyor shingling sheets received at the second conveyor with a third shingle distance that is larger than the first shingle distance.

* * * * *